US007559462B2

(12) United States Patent
Brosnan et al.

(10) Patent No.: US 7,559,462 B2
(45) **Date of Patent: *Jul. 14, 2009**

(54) CASHLESS INSTRUMENTS HAVING COUNTERFEIT PREVENTION FEATURES

(75) Inventors: William R. Brosnan, Reno, NV (US); Bryan D. Wolf, Reno, NV (US)

(73) Assignee: IGT, Reno, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/954,537

(22) Filed: Dec. 12, 2007

(65) Prior Publication Data

US 2008/0090648 A1 Apr. 17, 2008

(51) Int. Cl.
*G07F 19/00* (2006.01)

(52) U.S. Cl. ..... 235/379; 235/375; 235/384

(58) Field of Classification Search ..... 235/379, 235/375, 494, 384

See application file for complete search history.

(56) References Cited

U.S. PATENT DOCUMENTS

| | | | | |
|---|---|---|---|---|
| 5,283,422 | A | 2/1994 | Storch et al. | |
| 6,048,269 | A | 4/2000 | Burns et al. | |
| 6,110,044 | A | 8/2000 | Stern | |
| 6,652,380 | B1 | 11/2003 | Luciano | |
| 6,682,421 | B1 | 1/2004 | Rowe et al. | |
| 7,328,838 | B2 * | 2/2008 | Brosnan et al. | 235/379 |
| 2003/0141359 | A1 | 7/2003 | Dymovsky et al. | |
| 2003/0166412 | A1 | 9/2003 | Marcu | |
| 2003/0228907 | A1 | 12/2003 | Gatto et al. | |
| 2004/0058728 | A1 | 3/2004 | Fayter et al. | |

OTHER PUBLICATIONS

U.S. Appl. No. 09/631,855 filed on Aug. 3, 2000.

*CIAS, Inc.*, Plaintiff-Appellant, v. *Alliance Gaming Corporation* and *Bally Gaming, Inc.*, Defendants-Appellees, 2006-1342, United States Court of Appeals for the Federal Circuit, Sep. 27, 2007, 14 pages.

PCT International Search Report and Written Opinion mailed Nov. 30, 2005 from corresponding foreign application No. PCT/US2005/031706.

Notice of Allowance and Notice of Allowability from U.S. Appl. No. 10/938,934, dated Nov. 30, 2007.

Allowed Claims from U.S. Appl. No. 10/938,934.

Office Action from U.S. Appl. No. 10/938,934, dated Jun. 5, 2007.

* cited by examiner

*Primary Examiner*—Karl D. Frech
(74) *Attorney, Agent, or Firm*—Weaver Austin Villeneuve & Sampson LLP

(57) ABSTRACT

Cashless instruments having counterfeit prevention features and methods for detecting counterfeit cashless instruments are disclosed. A pattern of attempted redemptions or other transactional recordings of gaming machine printed tickets, vouchers or other cashless instruments having identification numbers with valid predictable fields but invalid unpredictable fields can indicate a likely counterfeiting attempt or operation. Occurrences can include a thief or other unscrupulous party discovering which gaming machine printed ticket fields lend themselves to prediction and which do not, and then attempting to guess at some of the randomly generated numbers in hopes of coming up with a valid number or number set. In addition, stored hash numbers can be compared to a hash number generated according to a one-way hash function. A pattern of invalid hash numbers can also indicate a likely counterfeit attempt.

18 Claims, 7 Drawing Sheets

CASHLESS INSTRUMENTS HAVING COUNTERFEIT PREVENTION FEATURES

CROSS REFERENCE TO RELATED APPLICATION

This application claims priority to commonly owned and co-pending U.S. patent application Ser. No. 10/938,934, filed on Sep. 9, 2004, which is incorporated herein by reference in its entirety and for all purposes.

TECHNICAL FIELD

The present invention relates generally to gaming machines and systems, and more specifically to methods and systems for providing and administering cashless instruments associated with gaming machines and systems.

BACKGROUND

Casinos and other forms of gaming comprise a growing multi-billion dollar industry wherein electronic and microprocessor based gaming machines have become increasingly popular in recent years. In a typical electronic gaming machine, such as a slot machine, video poker machine, video keno machine or the like, a game play is first initiated through a player wager of money or credit, whereupon the gaming machine determines a game outcome, presents the game outcome to the player and then potentially dispenses an award of some type, including a monetary award, depending upon the game outcome. Many additional gaming machine components, features and programs have been made possible in recent years through this proliferation of electronic gaming machines, including those involving linked progressive jackpots, player tracking and loyalty points programs, and various forms of cashless gaming, among other items. Many of these added components, features and programs can involve the implementation of various back-end and/or networked systems, including more hardware and software elements, as is generally known.

Electronic and microprocessor based gaming machines can include a variety of hardware and software components to provide a wide variety of game types and game playing capabilities, with such hardware and software components being generally well known in the art. A typical electronic gaming machine can include hardware devices and peripheral such as bill validators, coin acceptors, card readers, keypads, buttons, levers, touch screens, coin hoppers, player tracking units and the like. In addition, each gaming machine can have various audio and visual display components that can include, for example, speakers, display panels, belly and top glasses, exterior cabinet artwork, lights, and top box dioramas, as well as any number of video displays of various types to show game play and other assorted information, with such video display types including, for example, a cathode ray tube ("CRT"), a liquid crystal display ("LCD"), a light emitting diode ("LED"), a flat panel display and a plasma display, among others.

In addition, electronic gaming machines and gaming systems often employ cashless instruments for ease of paying out winnings to users, which can involve the use of ticket printers and other associated hardware and software components. Such cashless instruments can include, for example, paper tickets used in the EZ Pay® system by IGT of Reno, Nev., among others. Of course, other suitable items or devices can be used as such cashless instruments as well, and it is understood that the present invention is directed to all such items. Paper tickets in particular are printed by a printer at the gaming machine upon the request of a player at the completion of a game or gaming session, and signify a cash amount owed to the player, a portion of which might represent cash winnings owed to the player. Such paper tickets typically include appropriate currency or credit amounts, as well as various identification features printed on them, which can include a validation number or code.

It will be readily understood that such a validation number or code can be called a variety of names, such as a confirmation, identification, verification, and/or authentication number or code, among others, and that any such term or terms can be used where the basic function is to identify a specific cashless instrument that has been issued at a specific time and location. Such a verification number or code on a printed ticket is typically used in association with a matching confirmation number or code that is stored on the system, such that a match can be made with a recorded and outstanding number when a ticket is offered or received, whereby the ticket can be determined as valid and thus be accepted. For purposes of consistency within the present disclosure, the term "validation number" (or code) will be used with respect to printed tickets or other cashless instruments, while the term "confirmation number" (or code) will be used to denote those numbers or codes that are stored on a system.

Unfortunately, such printed tickets or other cashless instruments can be vulnerable to fraud in some instances, particularly where such tickets or systems of tickets are used in relatively simple formats. For instance, some cashless instruments and printed ticket systems might employ the use of a confirmation or identification number or code series that is generated according to a pattern or system that might be relatively easy to distinguish. A careful examination of several of such printed tickets or other such cashless instruments might reveal the pattern, system or some portion thereof, thus making it possible for a thief or other unscrupulous party to attempt to create counterfeit printed tickets that could be fraudulently redeemed for cash.

While existing systems and methods for providing printed tickets and other cashless instruments associated with gaming machines and gaming systems have been adequate in the past, improvements are usually welcomed and encouraged. In light of the foregoing, it is thus desirable to develop methods and systems for preventing or reducing fraud and other potential problems associated with printed tickets and cashless instruments, and in particular for detecting such counterfeit tickets and cashless instruments.

SUMMARY

It is an advantage of the present invention to provide systems and methods for the detection of counterfeit cashless instruments. This is accomplished in many embodiments by providing cashless instruments having validation numbers or codes with predictable fields and unpredictable fields. A pattern of attempted redemptions or other transactional recordings of printed tickets or other cashless instruments with validation numbers having valid predictable fields but invalid unpredictable fields can indicate a likely counterfeiting attempt or operation where a thief has discovered which fields lend themselves to prediction and which do not, and has attempted to guess at some randomly generated numbers or codes in hopes of coming up with a valid one. The detection of such a pattern signals a likely theft attempt.

Similarly, in another embodiment, cashless instruments can be printed with validation numbers. For each validation number, a separate hash number is stored, where the hash numbers are generated according to a one-way hash function. Accordingly, the hash number can be determined from the validation number, but the validation number cannot be determined from the hash number. As above then, a pattern of validation numbers without matching hash numbers indicates a likely attempt at producing a series of counterfeit cashless instruments. Additionally, as back-end systems store hash numbers without any way to determine corresponding validation numbers, gaming enterprises are less vulnerable to losses due to theft or pirating of their stored hash numbers.

The invention can be implemented in many ways, including as a method, system, device, apparatus, or computer readable medium. As a method of detecting possible counterfeit cashless instruments, one embodiment of the invention comprises receiving a cashless instrument having a validation number. The validation number has a predictable portion apparent from an observation of a plurality of the cashless instruments, and an unpredictable portion that is not apparent from the observation of the plurality of the cashless instruments. The validation number is compared to one or more confirmation numbers, where the predictable portion of the validation number is matched to corresponding portions of the confirmation numbers, so as to identify partially matched confirmation numbers. If at least one of the partially matched confirmation numbers is identified, and if the unpredictable portion of the validation number does not match any of the corresponding portions of the partially matched confirmation numbers, an indication of a possible counterfeit cashless instrument is generated.

As a computer readable memory to direct a computer to function in a specified manner, another embodiment of the invention comprises a first module to facilitate the receiving of a cashless instrument having a validation number, the validation number having a predictable portion apparent from an observation of a plurality of the cashless instruments, and an unpredictable portion that is not apparent from the observation of the plurality of the cashless instruments. The invention also comprises a second module to compare the validation number to one or more confirmation numbers. A third module is configured to match the predictable portion of the validation number to corresponding portions of the confirmation numbers, so as to identify partially matched confirmation numbers. A fourth module is configured to generate, if at least one of the partially matched confirmation numbers is identified, and if the unpredictable portion of the validation number does not match any of the corresponding portions of the partially matched confirmation numbers, an indication of a possible counterfeit cashless instrument.

As a method of detecting possible counterfeit cashless instruments, another embodiment of the invention comprises receiving a cashless instrument having a validation number, and generating from this validation number a hash number according to a one-way hash function. This hash number is then compared to a plurality of confirmation numbers, and if the hash number does not match at least one number of the plurality of confirmation numbers, an indication of a possible counterfeit cashless instrument is generated.

Other methods, features and advantages of the invention will be or will become apparent to one with skill in the art upon examination of the following figures and detailed description. It is intended that all such additional methods, features and advantages be included within this description, be within the scope of the invention, and be protected by the accompanying claims.

BRIEF DESCRIPTION OF THE DRAWINGS

The included drawings are for illustrative purposes and serve only to provide examples of possible structures and process steps for the disclosed inventive methods and systems for detecting counterfeit cashless instruments associated with a gaming machine or gaming system. These drawings in no way limit any changes in form and detail that may be made to the invention by one skilled in the art without departing from the spirit and scope of the invention. Like reference numerals refer to corresponding parts throughout the drawings, and it is understood that the depictions in the figures are diagrammatic and not necessarily to scale.

DETAILED DESCRIPTION

Exemplary applications of methods and systems according to the present invention are described as follows. These examples are being provided solely to add context and aid in the understanding of the invention. It will thus be apparent to one skilled in the art that the present invention may be practiced without some or all of these specific details. In other instances, well known process steps have not been described in detail in order to avoid unnecessarily obscuring the present invention. Other applications are possible, such that the following examples should not be taken as definitive or limiting in scope or setting. Although these examples are described in sufficient detail to enable one skilled in the art to practice the invention, it will be understood that they are not limiting, such that other embodiments may be used and changes may be made without departing from the spirit and scope of the invention.

Cashless instruments can be advantageously employed in gaming systems to reduce the need for gaming machines to carry money, thus making them less vulnerable to theft. Such cashless instruments also mean that users need not carry as much cash on their persons, also reducing the risk of theft or other loss. Such cashless instruments can be printed tickets that are produced and utilized by systems such as the EZ Pay® system illustrated below, although it should be noted that these cashless instruments can be produced and utilized by many different gaming systems while remaining within the scope of the invention. In certain embodiments of the present invention, printed tickets or other cashless instruments are generated with associated numbers, such as randomly generated number sequences, that can be used to verify the authenticity of the instrument. Such numbers are examined to determine whether a likely pattern of counterfeit cashless instruments exists. If so, corrective action may be taken to prevent fraud and/or loss.

Gaming Machines

Figure 1:
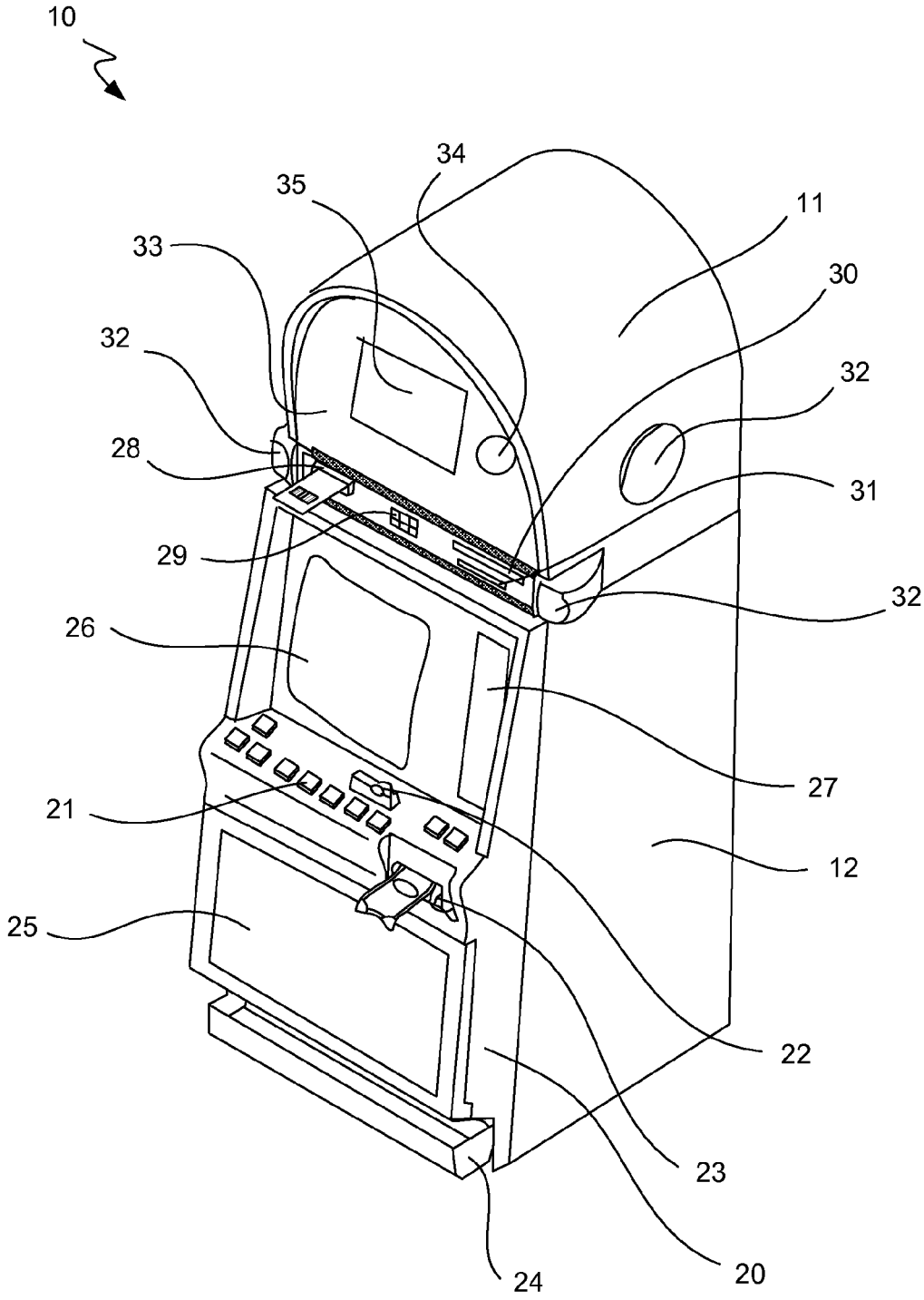
FIG. 1 illustrates in perspective view an exemplary gaming machine.

Referring first to FIG. 1, an exemplary gaming machine is illustrated in perspective view. Gaming machine 10 includes a top box 11 and a main cabinet 12, which generally surrounds the machine interior (not shown) and is viewable by users. This top box and/or main cabinet can together or separately form an exterior housing adapted to contain a plurality of internal gaming machine components therein. Main cabinet 12 includes a main door 20 on the front of the gaming machine, which preferably opens to provide access to the gaming machine interior. Attached to the main door are typically one or more player-input switches or buttons 21, one or more money or credit acceptors, such as a coin acceptor 22 and a bill or ticket validator 23, a coin tray 24, and a belly glass 25. Viewable through main door 20 is a primary video display monitor 26 and one or more information panels 27. The primary video display monitor 26 will typically be a cathode ray tube, high resolution flat-panel LCD, plasma/LED display or other conventional or other type of appropriate video monitor. Alternatively, a plurality of gaming reels can be used as a primary gaming machine display in place of display monitor 26, with such gaming reels preferably being electronically controlled, as will be readily appreciated by one skilled in the art.

Top box 11, which typically rests atop of the main cabinet 12, may contain a ticket printer 28, a key pad 29, one or more additional displays 30, a card reader 31, one or more speakers 32, a top glass 33, one or more cameras 34, and a secondary video display monitor 35, which can similarly be a cathode ray tube, a high resolution flat-panel LCD, a plasma/LED display or any other conventional or other type of appropriate video monitor. Alternatively, secondary display monitor 35 might also be foregone in place of other displays, such as gaming reels or physical dioramas that might include other moving components, such as, for example, one or more movable dice, a spinning wheel or a rotating display. It will be understood that many makes, models, types and varieties of gaming machines exist, that not every such gaming machine will include all or any of the foregoing items, and that many gaming machines will include other items not described above.

With respect to the basic gaming abilities provided, it will be readily understood that gaming machine 10 can be adapted for presenting and playing any of a number of gaming events, particularly games of chance involving a player wager and potential monetary payout, such as, for example, a wager on a sporting event or general play as a slot machine game, a keno game, a video poker game, a video blackjack game, and/or any other video table game, among others. While gaming machine 10 can typically be adapted for live game play with a physically present player, it is also contemplated that such a gaming machine may also be adapted for game play with a player at a remote gaming terminal. Other features and functions may also be used in association with gaming machine 10, and it is specifically contemplated that the present invention can be used in conjunction with such a gaming machine or device that might encompass any or all such additional types of features and functions. Gaming machines such as these and other variations and types are made by many manufacturers, such as, for example, IGT.

With respect to electronic gaming machines in particular, the electronic gaming machines made by IGT are provided with special features and additional circuitry that differentiate them from general-purpose computers, such as a laptop or desktop personal computer ("PC"). Because gaming machines are highly regulated to ensure fairness, and in many cases are operable to dispense monetary awards of millions of dollars, hardware and software architectures that differ significantly from those of general-purpose computers may be implemented into a typical electronic gaming machine in order to satisfy security concerns and the many strict regulatory requirements that apply to a gaming environment. A general description of many such specializations in electronic gaming machines relative to general-purpose computing machines and specific examples of the additional or different components and features found in such electronic gaming machines will now be provided.

At first glance, one might think that adapting PC technologies to the gaming industry would be a simple proposition, since both PCs and gaming machines employ microprocessors that control a variety of devices. However, because of such reasons as 1) the regulatory requirements that are placed upon gaming machines, 2) the harsh environment in which gaming machines operate, 3) security requirements and 4) fault tolerance requirements, adapting PC technologies to a gaming machine can be quite difficult. Further, techniques and methods for solving a problem in the PC industry, such as device compatibility and connectivity issues, might not be adequate in the gaming environment. For instance, a fault or a weakness tolerated in a PC, such as security holes in software or frequent crashes, may not be tolerated in a gaming machine because in a gaming machine these faults can lead to a direct loss of funds from the gaming machine, such as stolen cash or loss of revenue when the gaming machine is not operating properly.

Accordingly, one difference between gaming machines and common PC based computers or systems is that gaming machines are designed to be state-based systems. In a state-based system, the system stores and maintains its current state in a non-volatile memory, such that in the event of a power failure or other malfunction the gaming machine will return to its current state when the power is restored. For instance, if a player were shown an award for a game of chance and the power failed before the award was provided, the gaming machine, upon the restoration of power, would return to the state where the award was indicated. As anyone who has used a PC knows, PCs are not state machines, and a majority of data is usually lost when a malfunction occurs. This basic requirement affects the software and hardware design of a gaming machine in many ways.

A second important difference between gaming machines and common PC based computer systems is that for regulation purposes, the software on the gaming machine used to generate the game of chance and operate the gaming machine must be designed as static and monolithic to prevent cheating by the operator of gaming machine. For instance, one solution that has been employed in the gaming industry to prevent cheating and satisfy regulatory requirements has been to manufacture a gaming machine that can use a proprietary processor running instructions to generate the game of chance from an EPROM or other form of non-volatile memory. The coding instructions on the EPROM are static (non-changeable) and must be approved by a gaming regulator in a particular jurisdiction and installed in the presence of a person representing the gaming jurisdiction. Any change to any part of the software required to generate the game of chance, such as, for example, adding a new device driver used by the master gaming controller to operate a device during generation of the game of chance, can require a new EPROM to be burnt, approved by the gaming jurisdiction, and reinstalled on the gaming machine in the presence of a gaming regulator. Regardless of whether the EPROM solution is used, to gain approval in most gaming jurisdictions, a gaming machine must demonstrate sufficient safeguards that prevent an operator of the gaming machine from manipulating hardware and software in a manner that gives the operator an unfair or even illegal advantage over a player. The code validation requirements in the gaming industry affect both hardware and software designs on gaming machines.

A third important difference between gaming machines and common PC based computer systems is that the number and kinds of peripheral devices used on a gaming machine are not as great as on PC based computer systems. Traditionally in the gaming industry, gaming machines have been relatively simple in the sense that the number of peripheral devices and the number of functions on the gaming machine have been limited. Further, the functionality of a gaming machine tends to remain relatively constant once the gaming machine is deployed, in that new peripheral devices and new gaming software is infrequently added to an existing operational gaming machine. This differs from a PC, where users tend to buy new and different combinations of devices and software from different manufacturers, and then connect or install these new items to a PC to suit their individual needs. Therefore, the types of devices connected to a PC may vary greatly from user to user depending on their individual requirements, and may also vary significantly over time for a given PC.

Although the variety of devices available for a PC may be greater than on a gaming machine, gaming machines still have unique device requirements that differ from a PC, such as device security requirements not usually addressed by PCs. For instance, monetary devices such as coin dispensers, bill validators, ticket printers and computing devices that are used to govern the input and output of cash to a gaming machine have security requirements that are not typically addressed in PCs. Many PC techniques and methods developed to facilitate device connectivity and device compatibility do not address the emphasis placed on security in the gaming industry. To address some of these issues, a number of hardware/software components and architectures are utilized in gaming machines that are not typically found in general-purpose computing devices, such as PCs. These hardware/software components and architectures include, but are not limited to, items such as watchdog timers, voltage monitoring systems, state-based software architectures and supporting hardware, specialized communication interfaces, security monitoring, and trusted memory.

A watchdog timer is normally used in IGT gaming machines to provide a software failure detection mechanism. In a normal operating system, the operating software periodically accesses control registers in a watchdog timer subsystem to "re-trigger" the watchdog. Should the operating software not access the control registers within a preset timeframe, the watchdog timer will time out and generate a system reset. Typical watchdog timer circuits contain a loadable timeout counter register to allow the operating software to set the timeout interval within a certain time range. A differentiating feature of some preferred circuits is that the operating software cannot completely disable the function of the watchdog timer. In other words, the watchdog timer always functions from the time power is applied to the board.

IGT gaming computer platforms preferably use several power supply voltages to operate portions of the computer circuitry. These can be generated in a central power supply or locally on the computer board. If any of these voltages falls out of the tolerance limits of the circuitry they power, unpredictable operation of the computer may result. Though most modern general-purpose computers include voltage monitoring circuitry, these types of circuits only report voltage status to the operating software. Out of tolerance voltages can cause software malfunction, creating a potential uncontrolled condition in the gaming computer. IGT gaming machines, however, typically have power supplies with tighter voltage margins than that required by the operating circuitry. In addition, the voltage monitoring circuitry implemented in IGT gaming computers typically has two thresholds of control. The first threshold generates a software event that can be detected by the operating software and an error condition generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the computer.

The standard method of operation for IGT gaming machine game software is to use a state machine. Each function of the game (e.g., bet, play, result) is defined as a state. When a game moves from one state to another, critical data regarding the game software is stored in a custom non-volatile memory subsystem. In addition, game history information regarding previous games played, amounts wagered, and so forth also should be stored in a non-volatile memory device. This feature allows the game to recover operation to the current state of play in the event of a malfunction, loss of power, or the like. This is critical to ensure that correct wagers and credits are preserved. Typically, battery backed RAM devices are used to preserve this critical data. These memory devices are not used in typical general-purpose computers. Further, IGT gaming computers normally contain additional interfaces, including serial interfaces, to connect to specific subsystems internal and external to the gaming machine. The serial devices may have electrical interface requirements that differ from the "standard" EIA RS232 serial interfaces provided by general-purpose computers. These interfaces may include EIA RS485, EIA RS422, Fiber Optic Serial, optically coupled serial interfaces, current loop style serial interfaces, and the like. In addition, to conserve serial interfaces internally in the gaming machine, serial devices may be connected in a shared, daisy-chain fashion where multiple peripheral devices are connected to a single serial channel.

IGT gaming machines may alternatively be treated as peripheral devices to a casino communication controller and connected in a shared daisy chain fashion to a single serial interface. In both cases, the peripheral devices are preferably assigned device addresses. If so, the serial controller circuitry must implement a method to generate or detect unique device addresses. General-purpose computer serial ports are not able to do this. In addition, security monitoring circuits detect intrusion into an IGT gaming machine by monitoring security switches attached to access doors in the gaming machine cabinet. Preferably, access violations result in suspension of game play and can trigger additional security operations to preserve the current state of game play. These circuits also function when power is off by use of a battery backup. In power-off operation, these circuits continue to monitor the access doors of the gaming machine. When power is restored, the gaming machine can determine whether any security violations occurred while power was off, such as by software for reading status registers. This can trigger event log entries and further data authentication operations by the gaming machine software.

Trusted memory devices are preferably included in an IGT gaming machine computer to ensure the authenticity of the software that may be stored on less secure memory subsystems, such as mass storage devices. Trusted memory devices and controlling circuitry are typically designed to not allow modification of the code and data stored in the memory device while the memory device is installed in the gaming machine. The code and data stored in these devices may include, for example, authentication algorithms, random number generators, authentication keys, operating system kernels, and so forth. The purpose of these trusted memory devices is to provide gaming regulatory authorities a root trusted authority within the computing environment of the gaming machine that can be tracked and verified as original. This may be accomplished via removal of the trusted memory device from the gaming machine computer and verification of the secure memory device contents is a separate third party verification device. Once the trusted memory device is verified as authentic, and based on the approval of verification algorithms contained in the trusted device, the gaming machine is allowed to verify the authenticity of additional code and data that may be located in the gaming computer assembly, such as code and data stored on hard disk drives.

Mass storage devices used in a general-purpose computer typically allow code and data to be read from and written to the mass storage device. In a gaming machine environment, modification of the gaming code stored on a mass storage device is strictly controlled and would only be allowed under specific maintenance type events with electronic and physical enablers required. Though this level of security could be provided by software, IGT gaming computers that include mass storage devices preferably include hardware level mass storage data protection circuitry that operates at the circuit level to monitor attempts to modify data on the mass storage device and will generate both software and hardware error triggers should a data modification be attempted without the proper electronic and physical enablers being present. In addition to the basic gaming abilities provided, these and other features and functions serve to differentiate gaming machines into a special class of computing devices separate and distinct from general-purpose computers.

With respect to the basic gaming abilities provided, it will be readily understood that gaming machine 10 can be adapted for presenting and playing any of a number of gaming events, particularly games of chance involving a player wager and potential monetary or other payout, such as, for example, a wager on a sporting event or general play as a slot machine game, a keno game, a video poker game, a video blackjack game, and/or any other video table game, among others. While gaming machine 10 can typically be adapted for live game play with a physically present player, it is also contemplated that such a gaming machine may also be adapted for game play with a player at a remote gaming terminal. Other features, functions and devices may also be used in association with gaming machine 10, and it is contemplated that the present invention can be used in conjunction with a gaming machine or device that might encompass any or all such additional types of features, functions and devices. One item that is specifically contemplated for use with the present invention involves a gaming machine that incorporates a cashless instrument feature, such as a ticket printer and/or ticket acceptor for distributing and/or accepting printed tickets of a cashless system, such as the EZ Pay® system by IGT.

General Network and System Configurations

Figure 2:
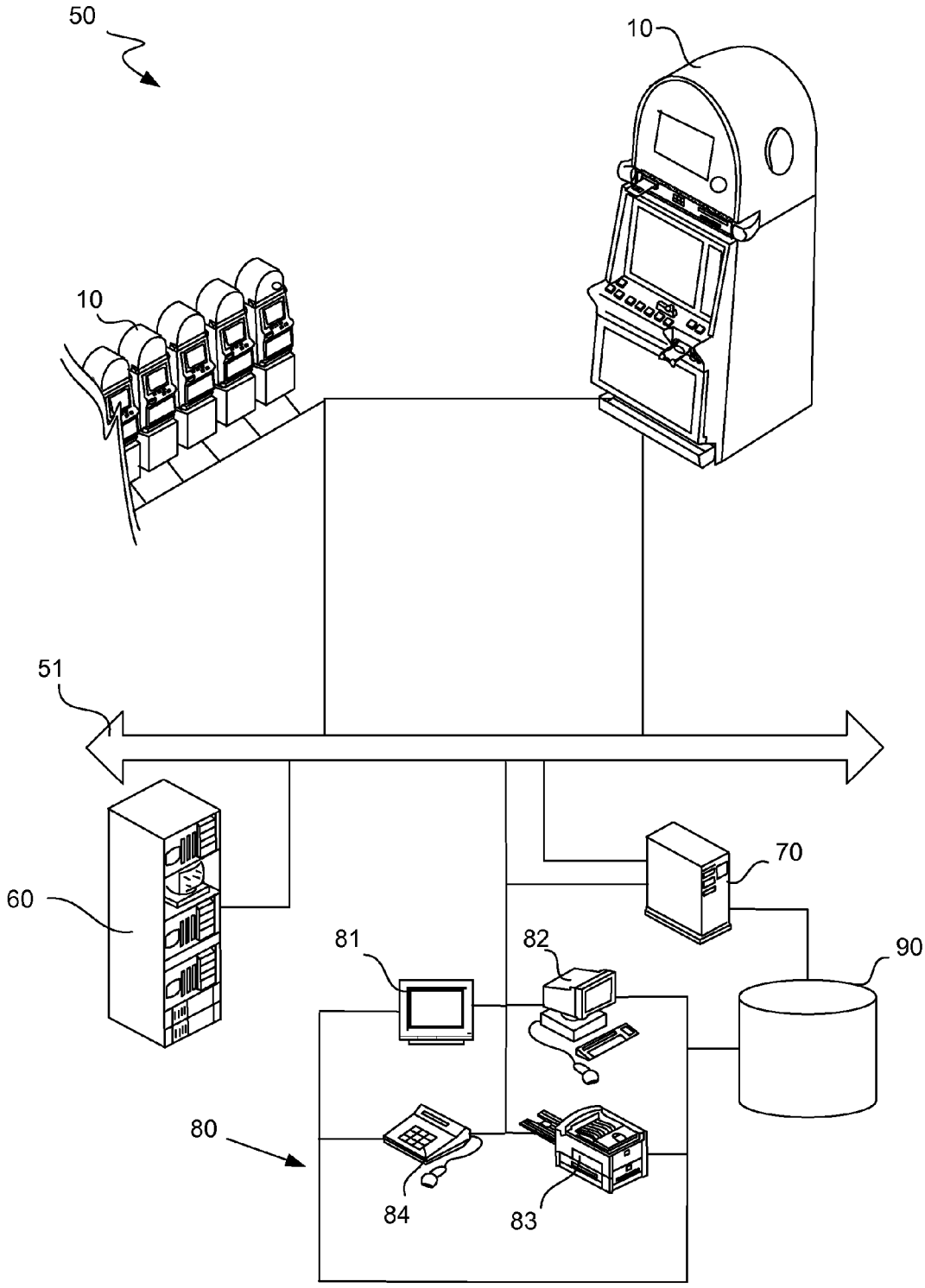
FIG. 2 illustrates in block diagram format an exemplary network infrastructure for providing a gaming system having one or more gaming machines.

Turning now to FIG. 2, an exemplary network infrastructure for providing a gaming system having one or more gaming machines is illustrated in block diagram format. Exemplary gaming system 50 has one or more gaming machines, various communication items, and a number of host-side components and devices adapted for use within a gaming environment. As shown, one or more gaming machines 10 adapted for use in gaming system 50 can be in a plurality of locations, such as in banks on a casino floor or standing alone at a smaller non-gaming establishment, as desired. Common bus 51 can connect one or more gaming machines or devices to a number of networked devices on the gaming system 50, such as, for example, a general-purpose server 60, one or more special-purpose servers 70, a sub-network of peripheral devices 80, and/or a database 90.

A general-purpose server 70 may be one that is already present within a casino or other establishment for one or more other purposes beyond any monitoring or administering involving gaming machines. Functions for such a general-purpose server can include other general and game specific accounting functions, payroll functions, general Internet and e-mail capabilities, switchboard communications, and reservations and other hotel and restaurant operations, as well as other assorted general establishment record keeping and operations. In some cases, specific gaming related functions such as cashless gaming, downloadable gaming, player tracking, remote game administration, video or other data transmission, or other types of functions may also be associated with or performed by such a general-purpose server. For example, such a server may contain various programs related to cashless gaming administration, player tracking operations, specific player account administration, remote game play administration, remote game player verification, remote gaming administration, downloadable gaming administration, and/or visual image or video data storage, transfer and distribution, and may also be linked to one or more gaming machines, in some cases forming a network that includes all or many of the gaming devices and/or machines within the establishment. Communications can then be exchanged from each adapted gaming machine to one or more related programs or modules on the general-purpose server.

In one embodiment, gaming system 50 contains one or more special-purpose servers that can be used for various functions relating to the provision of cashless gaming and gaming machine administration and operation under the present methods and systems. Such a special-purpose server or servers could include, for example, a cashless gaming server, a player verification server, a general game server, a downloadable games server, a specialized accounting server, and/or a visual image or video distribution server, among others. Of course, these functions may all be combined onto a single server, such as specialized server 70. Such additional special-purpose servers are desirable for a variety of reasons, such as, for example, to lessen the burden on an existing general-purpose server or to isolate or wall off some or all gaming machine administration and operations data and functions from the general-purpose server and thereby increase security and limit the possible modes of access to such operations and information.

Alternatively, exemplary gaming system 50 can be isolated from any other network at the establishment, such that a general-purpose server 60 is essentially impractical and unnecessary. Under either embodiment of an isolated or shared network, one or more of the special-purpose servers are preferably connected to sub-network 80, which might be, for example, a cashier station or terminal. Peripheral devices in this sub-network may include, for example, one or more video displays 81, one or more user terminals 82, one or more printers 83, and one or more other input devices 84, such as a card reader or other security identifier, among others. Similarly, under either embodiment of an isolated or shared network, at least the specialized server 70 or another similar component within a general-purpose server 60 also preferably includes a connection to a database or other suitable storage medium 90. Database 90 is preferably adapted to store many or all files containing pertinent data or information regarding cashless instruments such as printed tickets, among other potential items. Files, data and other information on database 90 can be stored for backup purposes, and are preferably accessible at one or more system locations, such as at a general-purpose server 60, a special purpose server 70 and/or a cashier station or other sub-network location 80, as desired.

While gaming system 50 can be a system that is specially designed and created new for use in a casino or gaming establishment, it is also possible that many items in this system can be taken or adopted from an existing gaming system. For example, gaming system 50 could represent an existing cashless gaming system to which one or more of the inventive components or program modules are added. In addition to new hardware, new functionality via new software, modules, updates or otherwise can be provided to an existing database 90, specialized server 70 and/or general-purpose server 60, as desired. In this manner, the methods and systems of the present invention may be practiced at reduced costs by gaming operators that already have existing gaming systems, such as an existing EZ Pay® or other cashless gaming system, by simply modifying the existing system. Other modifications to an existing system may also be necessary, as might be readily appreciated.

Specific Cashless Gaming System Configuration

Figure 3:
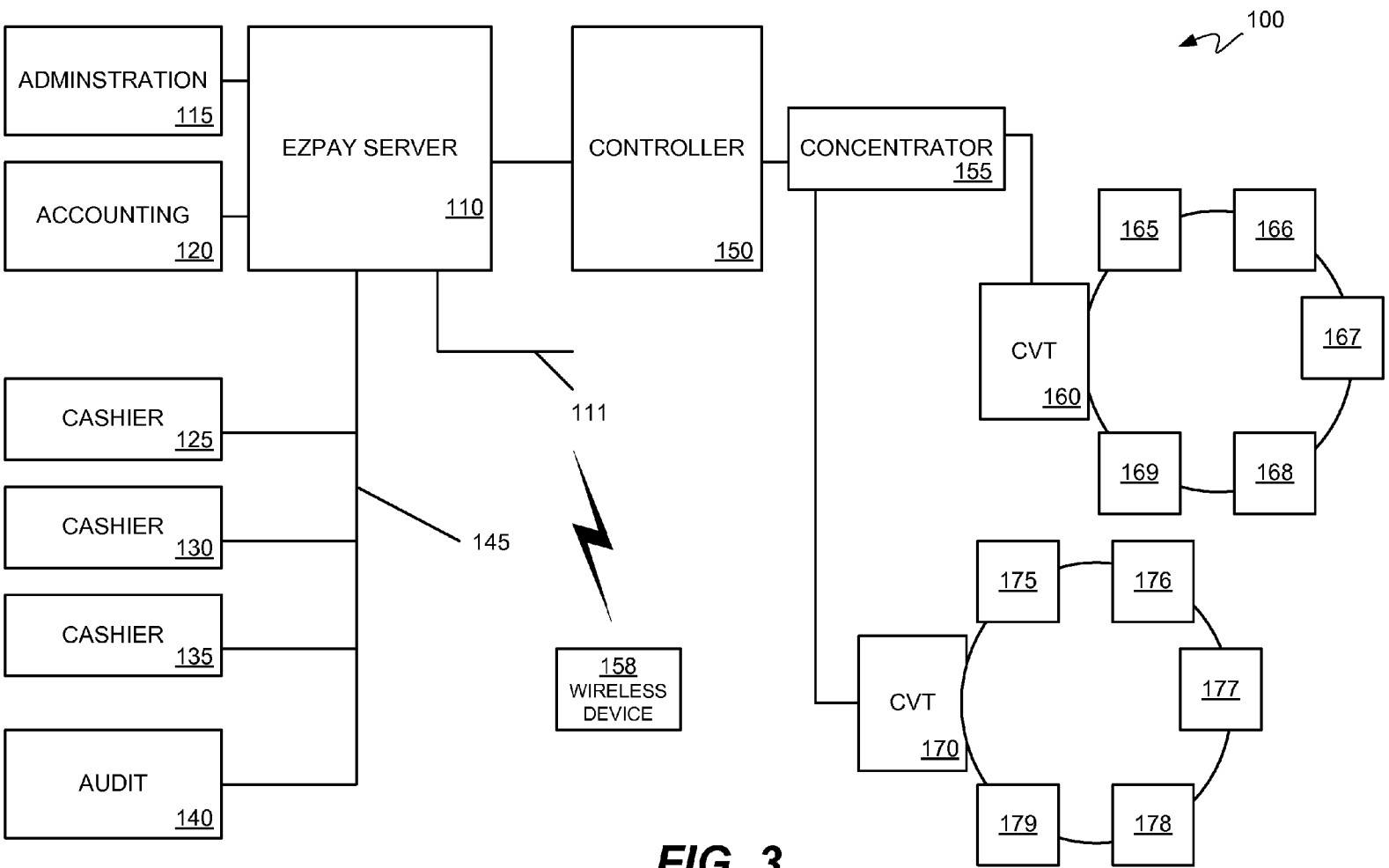
FIG. 3 illustrates in block diagram format various components of a cashless gaming system using the EZ Pay® printed ticket system.

Continuing on to FIG. 3, a block diagram of the components of a cashless system using the EZ Pay® printed ticket system according to one embodiment of the present invention is illustrated. Cashless gaming system 100 includes various hardware components and software components needed to generate and validate cashless instruments. Components of this cashless system can include, for example, 1) data acquisition hardware, 2) data storage hardware, 3) cashless instrument generation and validation hardware (e.g. printers, card readers, ticket acceptors, validation terminals, etc.), 3) auditing software, 4) cashless instrument validation software and 5) database software. Many types of cashless systems are possible and are not limited to the components listed above, or embodiments such as the EZ Pay® printed ticket system. Although the cashless instruments used in such a system can be referred to as printed tickets, ticket vouchers, cash vouchers, tickets, vouchers, and other various names, the terms "printed ticket" and "ticket" will be used herein, and will be understood to encompass all such variations, possibilities and terminologies.

A first group of gaming machines, 165, 166, 167, 168 and 169, is shown as being connected to a first clerk validation terminal ("CVT") 160, while a second group of gaming machines, 175, 176, 177, 178 and 179, is shown as being connected to a second CVT 170. Other groups of gaming machines and CVTs may also be present within this cashless gaming system 100, as will be readily appreciated. Many or all of such gaming machines can be adapted to issue printed tickets that can be exchanged for cash or accepted as credit of indicia in other gaming machine located within the cashless system 100. In this example, the printed ticket serves as a cashless instrument. In addition, one or more of these gaming machines may be adapted to accept printed tickets as well, which can be those issued within cashless gaming system 100, and possibly those issued at a different system or separate gaming property. Such a different system or gaming property may or may not utilize the same cashless system as that of cashless system 100.

Where the CVTs are not connected to one another in some way, a printed ticket issued from one gaming machine may typically be only be used as indicia of credit in another gaming machine that is in a group of gaming machines connected to the same CVT. For example, if CVT 160 and CVT 170 were completely independent and unconnected to each other in any way, a printed ticket issued from gaming machine 165 might be used as an indicia of credit in any of gaming machines 166, 167, 168 or 169, each of which are connected to common CVT 160, but not in any of gaming machines 175, 176, 177, 178, or 179, which are each connected to the other CVT 170. In an analogous manner, when the cashless systems from one casino or gaming property are not connected together in any way, then a printed ticket generated from gaming machine 166 might be not be usable at a property different from any properties that are within cashless system 100. Of course, where CVTs are connected either directly or as part of a larger system, as is shown here, then printed tickets from one set of gaming machines under one CVT 160 might be redeemable at another set of gaming machine under the other connected CVT 170, and vice-versa.

CVTs 160 and 170 are typically adapted to store cashless instrument transaction information corresponding to outstanding cashless instruments that are waiting for redemption, including printed tickets, smart cards and debit cards, among others. In this embodiment, the CVTs are separate from the gaming machines. However, the cashless instrument information may be also be stored within each gaming machine. Alternatively, one gaming machine may functionally act as a CVT for a group of gaming machines, thus eliminating a need for separate CVT hardware. In addition, cashless instrument transaction information may be stored at a cashless server, such as EZ Pay® server 110. Such a server can be identical or substantially similar to a portion of general-purpose server 60 or a special-purpose server 70 of the foregoing exemplary network configuration, for example. The cashless instrument transaction information may be used when the tickets are validated and cashed out or redeemed in some other manner. The CVTs 160 and 170 may store the information for the printed tickets issued by the gaming machines connected to the CVT. For example, CVT 160 can be adapted to store printed ticket information for printed tickets issued by gaming machines 165, 166, 167, 168, and 169. When a ticket is printed out, ticket information is sent to the CVT using a communication protocol of some type from the gaming machine. For example, a gaming machine may send transaction information to a CVT that is part of a cashless system using the slot acquisition system ("SAS") made by IGT, or the slot data system ("SDS") made by Bally Gaming Systems (Alliance Gaming Corporation of Las Vegas, Nev.).

In this embodiment, when a player wishes to cash out a printed ticket, the player may redeem tickets printed from a particular gaming machine at the CVT associated with the gaming machine, or at any other CVT that is part of the cashless system associated with the first CVT. For example, since CVT 160 and CVT 170 are connected as part of a single cashless system to the EZ Pay® server 110, a player or other user may redeem or utilize printed tickets at the gaming machines, the CVTs 160 or 170, the cashiers 125, 130 or 135, or the wireless cashier or cashiers 158. These CVTs, cashiers, wireless cashiers and gaming machines may be referred to as "cashless validation sites." To cash out the printed ticket, the ticket is validated by comparing information obtained from the printed ticket with information stored within the CVT. After a printed ticket has been cashed out, the CVT marks that ticket as being paid in a database to prevent a printed ticket with similar information from being cashed multiple times.

Not all cashless systems may utilize CVTs, and many of the functions of a CVT may be transferred to a cashless server, such as the EZ Pay® server 110, thus eliminating the need for a CVT or various functions within an existing CVT. For instance, the cashless instrument transaction information may be stored in the cashless server instead of the CVT. Thus, the need to store cashless instrument transaction information within the CVT may be eliminated. In this embodiment using the EZ Pay® system, multiple groups of gaming machines connected to CVTs are connected together in a cross validation network 145. The cross validation network is typically comprised of one or more concentrators 155 that accept inputs from two or more CVTs and enable communications to and from the two or more CVTs using one communication line. Each concentrator can be connected to a front-end controller 150 that may poll the CVTs for printed ticket information. This front-end controller is connected to an EZ Pay® server 110, which may in turn provide various information services to other system components, which can include accounting 120 and administration 115 computers, modules, locations or units, among others.

One hardware and software platform allowing cashless instruments to be utilized at all of the cashless validation sites (e.g., cashier stations, gaming machines, wireless cashiers and CVTs) within a single property and across multiple properties can be referred to as a "cashless server." In this embodiment, an EZ Pay® server 110 may function as the cashless server. Usually, this cashless server is a communication nexus in the cross validation network 145. For instance, the EZ Pay® server 110 can be connected to the cashiers, wireless devices, remote cashless instrument transaction clearinghouse, CVTs and the gaming machines via the CVTs, among other items.

The cross validation network 145 allows printed tickets generated by any gaming machine connected to the cross validation network to be accepted by other gaming machines in the cross validation network. Additionally, the cross validation network allows a cashier at a cashier station 125, 130, or 135 to validate any printed ticket generated from a gaming machine within the cross validation network 145. To cash out a printed ticket, a player may present the printed ticket at one of the cashier stations 125, 130, and 135, or to a game service representative carrying a wireless gaming device 158 for validating printed tickets. Further details of such a wireless gaming device 158, including hardware and utilization, are described in copending and commonly owned U.S. Pat. No. 6,682,421, entitled "WIRELESS GAME ENVIRONMENT," filed Apr. 7, 2000 by Rowe, which is incorporated herein by reference in its entirety and for all purposes. Information obtained from the printed ticket is used to validate the ticket by comparing information on the ticket with information stored on one of the CVTs connected to the cross validation network 145. In addition, when the printed ticket was issued at another property, the information on the ticket may be stored at the other property. Thus, to validate the printed ticket, the EZ Pay® server may have to communicate with the cashless instrument transaction clearinghouse via a remote connection 111 or other similar means to obtain the information necessary to validate the printed ticket.

As printed tickets are issued and/or validated, this information can be sent to an audit services computer or unit 140 providing audit services, an accounting computer or unit 120 providing accounting services, and/or an administration computer or unit 115 providing administration services. In another embodiment, all of these services may be provided by a cashless server, such as EZ Pay® server 110. Examples of auditing services, which may be provided by cashless system software residing on an auditing computer 140, include 1) session reconciliation reports, 2) soft count reports, 3) soft count verification reports, 4) soft count exception reports, 5) machine ticket status reports and 6) security access reports, among others. Examples of accounting services, which may be provided by cashless system software residing on an accounting computer 120, include 1) ticket issuance reports, 2) ticket liability reports, 3) expired ticket reports, 4) expired ticket paid reports and 5) ticket redemption reports, among others. Examples of administration services, which may be provided by cashless system software residing on an administration computer 115 include 1) manual ticket receipts, 2) manual ticket reports, 3) ticket validation reports, 4) interim validation reports, 5) validation window closer reports, 6) voided ticket receipts and 7) voided ticket reports, among others.

Secure Validation Numbers and Counterfeit Detection

The cashless instruments or printed tickets described above can in some instances be susceptible to counterfeiting by those that wish to fabricate false cashless instruments and redeem them for money. In particular, cashless instruments are often printed with a validation number (or code) that is used to determine authenticity. Typically, the validation number is printed on the printed ticket and a corresponding (e.g., matching) confirmation number is also stored in a back-end system, such as at EZ Pay® server 110 or an associated database. When a printed ticket is redeemed, its validation number or code is checked to see if it matches the stored confirmation number or code in the EZ Pay® server 110 or an associated database. If so, the printed ticket amount is paid out. However, such validation numbers are often just number strings that may have predictable portions and/or unpredictable portions.

For example, validation numbers are often generated as a multiple-digit number or code, such as a 10 digit number "1234567890," where the first seven digits "1234567" are used for every printed ticket generated at a given location and time frame, while the last three digits "890" are sequentially or randomly generated with each new ticket printed at that location and during that time frame. Thus, a printed ticket could be issued with the validation number "1234567890," and 100 tickets later another printed ticket might be printed with the validation number "1234567215," and so forth. As will be readily appreciated, characters other than numbers might also be used in such a number or code validation system, with such characters including letters, dashes, punctuation marks and the like. Alternatively, bar codes or other devices could be used in such a ticket validation system. It will be understood that any and all such alternative uses of other characters and/or devices can be used in conjunction with the methods and systems of the present invention. In yet another specific example, a multiple-digit number or code for a printed ticket might be represented as "1234-ABCD-5678-efgh," where the first two sets of characters can represent the gaming establishment, gaming machine, time and date, among other items, and thus appear to remain constant and/or can be readily discerned by a thief or other unscrupulous party attempting to decipher printed tickets. The third set of characters might simply involve a sequential numbering system for printed tickets, while the fourth set of characters represents a randomly generated set of numbers or other characters that cannot be predicted.

A potential thief or other unscrupulous party might then discern such a pattern by a simple inspection of several printed tickets, thus guessing that one or more sets of digits remain the same, while others sets or individual digits are varied, perhaps sequentially, perhaps randomly, or in some other manner. The potential thief could then create his or her own printed tickets with the same constant or predictable digits, and guess at the variable or random digits, hoping to get lucky for an "easy" cash out of a fraudulent ticket. To combat such an approach, various methods and systems disclosed herein are adapted to examine the redemptions or attempted redemptions of printed tickets for patterns. In particular, a potential counterfeit situation can be noted if one or more printed tickets are submitted for redemption having verification numbers with correct predictable portions (e.g., "1234567") but incorrect unpredictable portions (e.g., "788," where the EZ Pay® server does not have a record of a validation number with those last three digits).

While the predictable and unpredictable portions of the validation numbers or codes described above can be constant, semi-constant, sequential or random, the inventive methods and systems disclosed herein are not limited to any specific combination or permutation. Rather, the methods and systems disclosed herein can include all such possibilities, such as predictable portions that remain constant, as well as those that can vary, but in a reasonably predictable manner. For example, a predictable portion or portions of a validation number can be generated according to a sequence or pattern. The methods and systems disclosed herein also include unpredictable validation portions that need not be truly "unpredictable," but rather are generated according to some method or pattern that is difficult to readily deduce. For instance, the unpredictable portion of a validation number or code can be generated according to a difficult-to-determine sequence, or it can be pseudo-randomly generated, or truly randomly generated.

Figure 4:
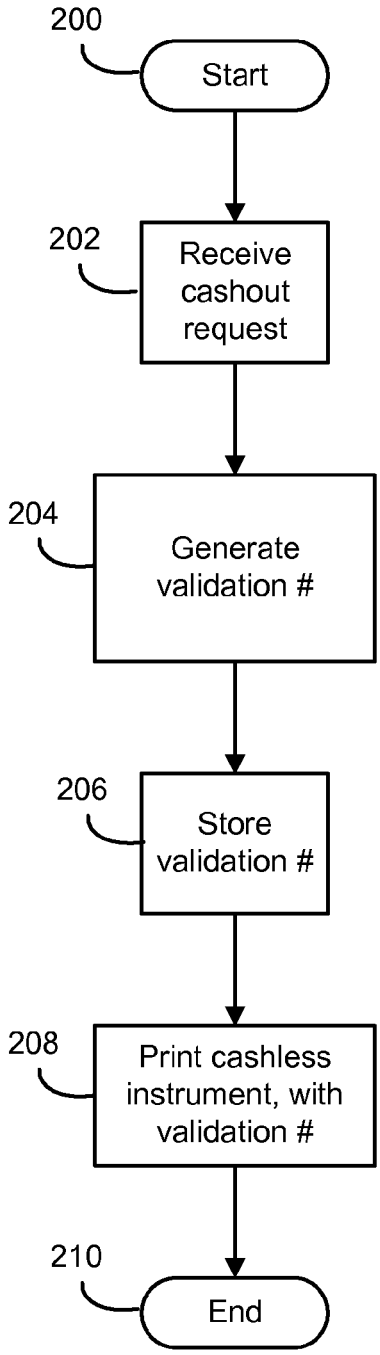
FIG. 4 illustrates one method of printing cashless instruments having validation numbers structured according to one embodiment of the present invention.
Figure 5:
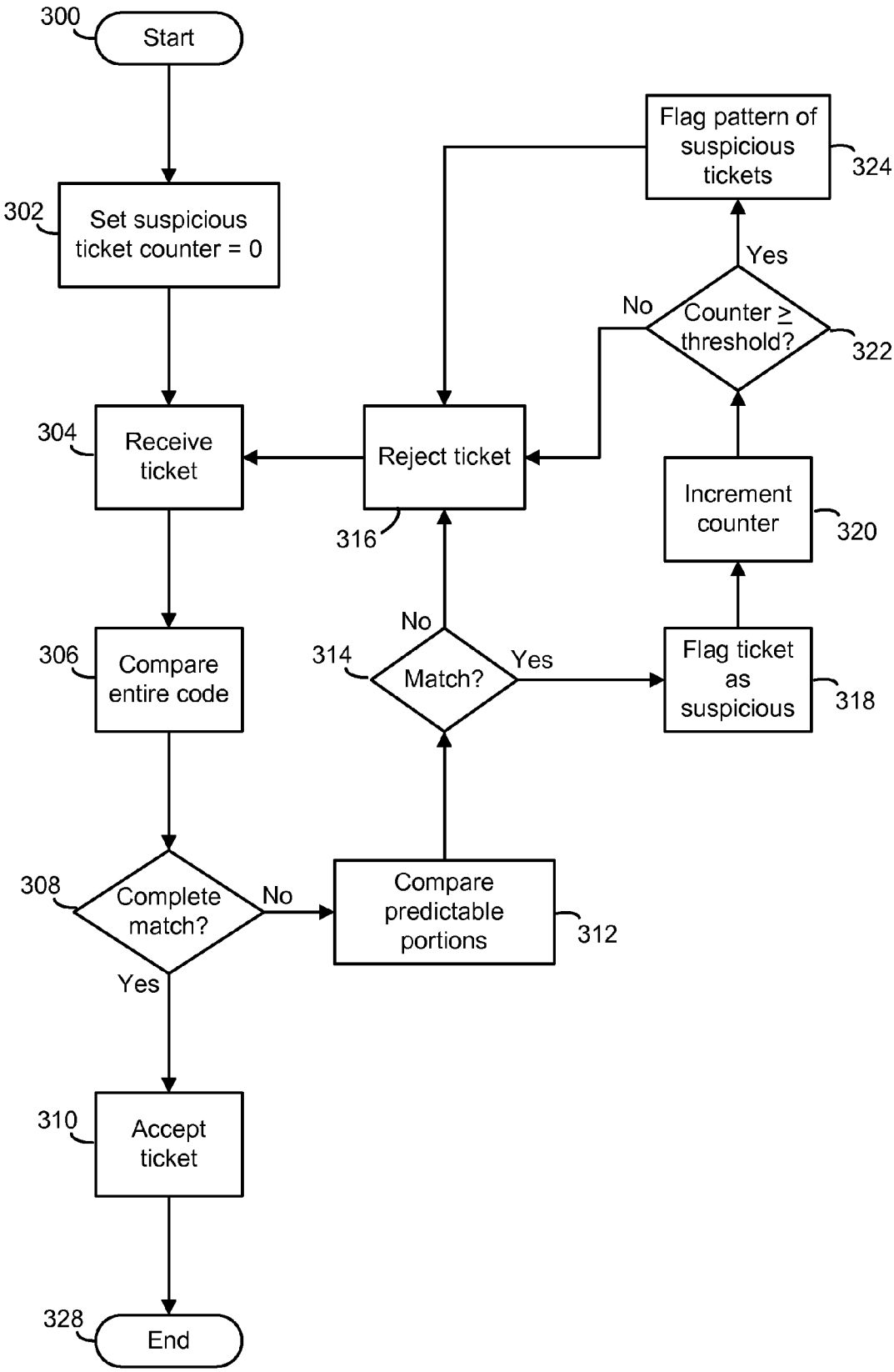
FIG. 5 illustrates one method of detecting counterfeit cashless instruments having validation numbers structured in a particular manner according to one embodiment of the present invention.

One such method of printing and verifying tickets with more secure validation numbers or codes is illustrated in FIGS. 4-5. FIG. 4 illustrates a flowchart of one way of generating more secure validation numbers and producing or printing tickets or other cashless instruments including such validation numbers, while FIG. 5 illustrates a flowchart of one way of examining such printed tickets or other cashless instruments to determine whether it is likely that counterfeit printed tickets or other cashless instruments are being created. It will be readily appreciated that not every element and step within either flowchart is necessary, and that it is possible to practice embodiments that only embrace portions of these illustrated processes and omit others. It will also be understood that other steps might be added, and that the order of steps can be rearranged as desired where applicable.

Turning first to FIG. 4, as stated previously, gaming machines such as machines 165-169 can be configured to issue cashless instruments or printed tickets. When users wish to end their gaming sessions and "cash out," they can indicate such a desire to a gaming machine, typically by pressing a button or other input device. After a start step 200, the cash out request is received at a process step 202. In one embodiment, this cash out request is transmitted to a server or other central device, such as a CVT 160 or server 110. At a following process step 204, the central device, such as CVT 160 or server 110, then generates a validation number with a predictable portion and an unpredictable portion, such as in any of the foregoing examples. At process step 206, this validation number is then stored for later use, such as at the CVT and/or at the server 110. The CVT 160, server 110, or other central device then transmits the validation number and any other necessary information to the pertinent gaming machine 165-169, such as the date, time, appropriate monetary amount, validation and so forth, as desired. The gaming machine 165-169 then prints the ticket or other cashless instrument at a following process step 208, with the printed ticket including the validation number and a monetary amount owed to the holder, a portion of which may be the winnings of the user. The ticket printing or cashless instrument process then ends at end step 210.

When a holder of this printed ticket or other cashless instrument attempts to redeem the printed ticket or cashless instrument for payment, the validation number thereon is examined to determine its authenticity. If the validation number does not match a confirmation number stored in the EZ Pay® server 110, CVT 160, or other central tracking item or pertinent database, the printed ticket holder is not paid. In addition, if the predictable portion of the validation number on the printed ticket or cashless instrument matches a corresponding predictable portion that is stored in the EZ Pay® server 110, CVT 160, or other central tracking item or pertinent database, but the unpredictable portion does not, then the printed ticket or other cashless instrument is flagged as suspicious and/or a possible counterfeit ticket. More than one of these suspicious printed tickets or other cashless instruments may raise even further suspicion.

To accomplish this, a count can be kept of suspicious tickets, such as that which is shown in the process of FIG. 5. After a start step 300, a "suspicious ticket counter" or other similar item is initially set to zero or some other start value at a first process step 302. A printed ticket is then received at process step 304, whereupon its entire validation number or code is compared to entire confirmation numbers or codes that are stored by the EZ Pay® server 110, CVT 160, or other central tracking item or pertinent database at process step 306. At a following decision step 308, an inquiry is made as to whether there is a complete match of the validation number or code on the received ticket to any of the confirmation numbers or codes that are stored. If a complete match is found, then the ticket is accepted at process step 310, and the method ends at end step 328.

If no complete matches are found, however, then the process continues to step 312, where one or more predictable portions of the validation number or code are compared to corresponding predictable portions of those confirmation numbers or codes stored on the system. At a following decision step 314, an inquiry is made as to whether there is a match of any predictable portion of a validation number or code on the received ticket to any corresponding predicable portion of any confirmation number or code that is stored. If no such match is found, then the ticket is simply rejected at process step 316, and the method reverts to step 304 to wait for another ticket to be offered or received. However, if one or more matches of predictable portions are found (i.e., one or more stored confirmation numbers have portions matching the predictable portions of the validation number on the received printed ticket), then the printed ticket is flagged as suspicious at process step 318, and the "suspicious ticket" counter is incremented at step 320.

At a following decision step 322, an inquiry is then made as to whether the value of the suspicious ticket counter has met or exceeded a threshold value, which can be set as desired by the operator or other administering authority. This threshold value can be set to any number, and it is specifically contemplated that the determination of an appropriate threshold value can be made by any method. For instance, it might be known empirically or by experience that a threshold value of five "nonmatching" printed tickets signifies the likely presence of a counterfeit attempt, whereas anything below that amount is can likely be attributed to human and/or machine error. Other methods may arrive at other threshold values, while remaining within the scope of the present invention. If this threshold is exceeded, the EZ Pay® server 110, CVT 160 or some other device can flag the presence of a likely pattern of suspicious printed tickets at a process step 324, with the printed ticket of course being rejected at step 316. If the set threshold is not exceeded, then the printed ticket is merely rejected at step 316.

While it is possible to detect possible counterfeit printed tickets or other cashless instruments according to whether their validation numbers match a stored confirmation number or value, the stored number or value itself is still subject to theft or copying. For instance, an "insider" with access to stored values might be able to make copies of confirmation numbers stored on the EZ Pay® server 110 or other system storage component, and could then replicate printed tickets with these or appropriately corresponding validation numbers, ensuring that such counterfeit printed tickets would hold up to scrutiny. With respect to such events, the present invention also encompasses other approaches besides the simple storing of easily transferable confirmation numbers. For example, a validation number can be printed on the ticket, and also used to generate a hash number via a one-way hash algorithm. One-way hash algorithms are known algorithms that generate, for each input number, an output number that is very difficult, if not impossible, to relate back to the input number. More specifically, given an output or "hash" number, it is extremely difficult, and in some cases impossible, to calculate the corresponding input number, even when the hash algorithm is known. Thus, such algorithms are "one-way" algorithms: given the input validation number, one can determine a hash number, but given the hash number, one cannot readily determine the validation number. The EZ Pay® server 110 or other system storage component could then store as the confirmation number or code just the hash number and not the validation number, thus making it difficult if not impossible for potential thieves or other unscrupulous parties to determine the correct validation numbers, even when they might have access to the hash numbers.

Figure 6:
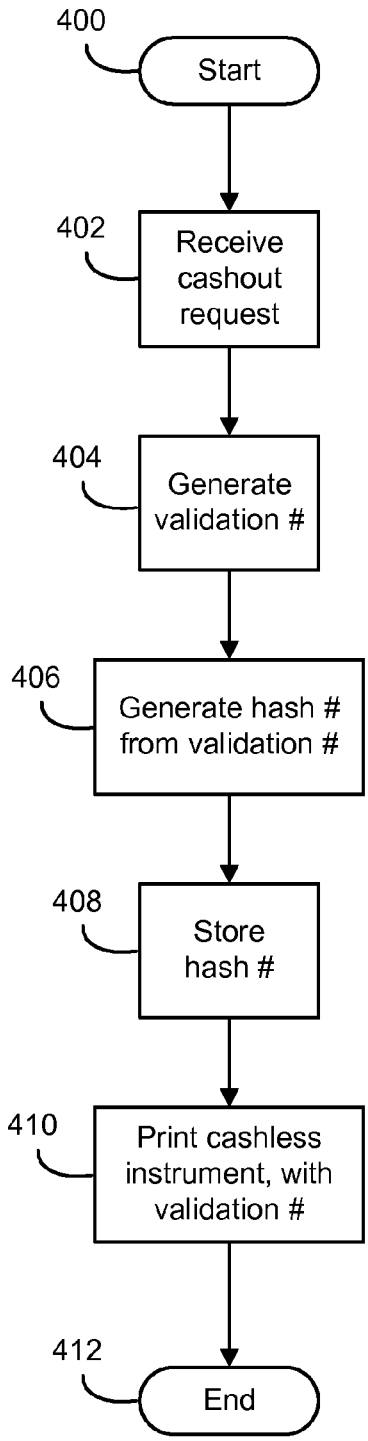
FIG. 6 illustrates one method of printing cashless instruments having validation and hash numbers structured in a particular manner according to one embodiment of the present invention.
Figure 7:
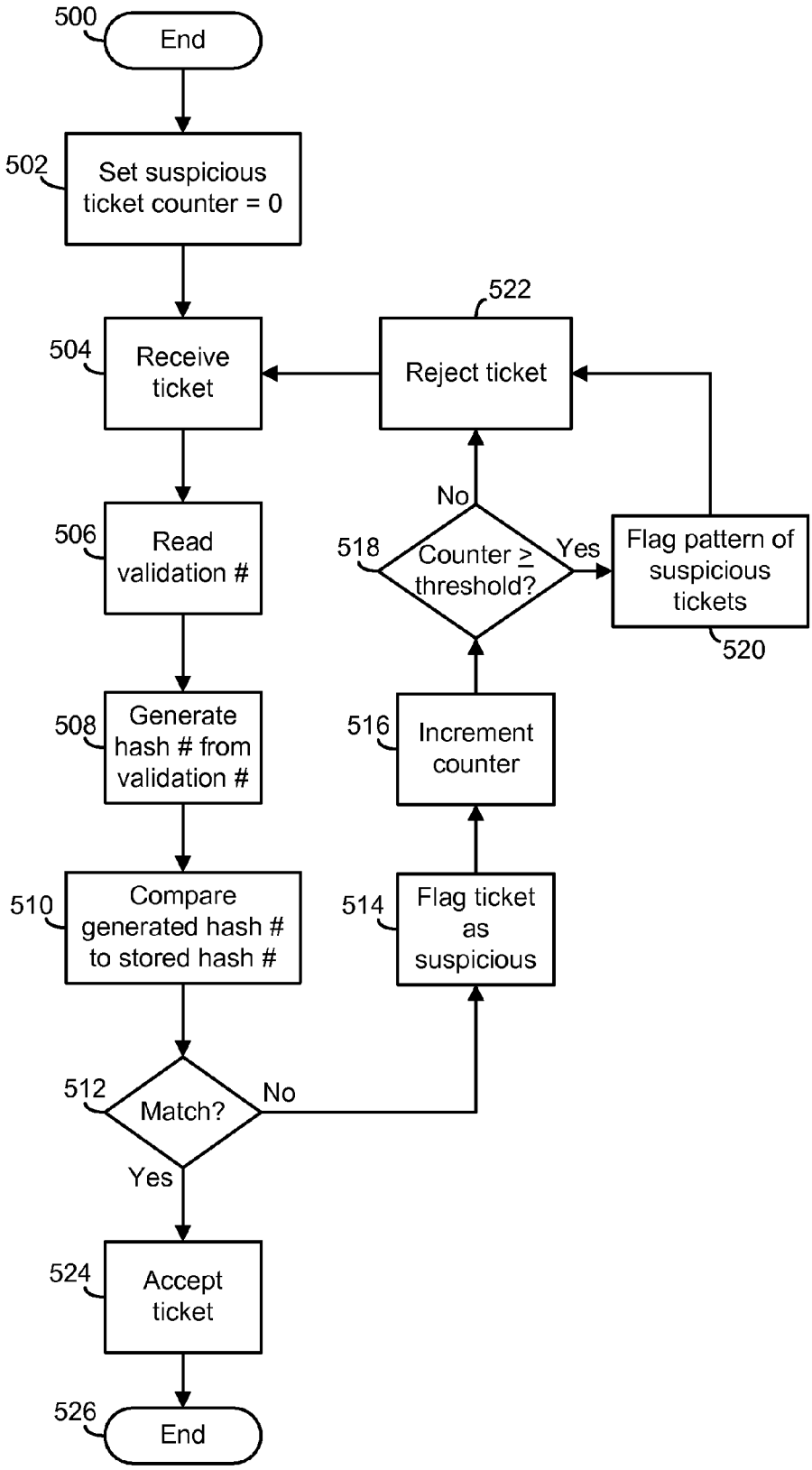
FIG. 7 illustrates one method of detecting counterfeit cashless instruments having validation and hash numbers structured in a particular manner according to one embodiment of the present invention.

Another method of printing and verifying tickets with more secure validation numbers or codes, this time by incorporating the use of hash numbers, codes or values, is illustrated in FIGS. 6-7. FIG. 6 illustrates a flowchart of one method of generating validation numbers or codes and their corresponding hash numbers or values, while FIG. 7 illustrates a flowchart of one way of examining printed tickets or other cashless instruments and their hash numbers to determine a likelihood that counterfeit printed tickets are being created. As in the above examples, it will be understood that not every element and step within either flowchart is necessary, and that it is possible to practice embodiments that only embrace portions of these illustrated processes and omit others. It will also be understood that other steps might be added, and that the order of steps can be rearranged as desired where applicable.

Referring first to FIG. 6, gaming machines such as machines 165-169 again can be configured to issue cashless instruments or printed tickets. When users wish to end their gaming sessions and "cash out," they can indicate such a desire to a gaming machine, typically by pressing a button or other input device. After a start step 400, the cash out request is received at a process step 402. In one embodiment, this cash out request is similarly transmitted to a server or other central device, such as a CVT 160 or server 110. At a following process step 404, the CVT, server or other device then generates a validation number. At process step 406, a hash number is generated from this validation number via a one-way hash function, such as those detailed above. This hash number is then stored for later use, such as at the CVT and/or at the server 110 at process step 408. The CVT 160, server 110, or other central device then transmits the validation number and any other necessary information to the pertinent gaming machine 165-169, such as the date, time, appropriate monetary amount, validation and so forth, as desired. The gaming machine 165-169 then prints the ticket or other cashless instrument at a following process step 410, with the printed ticket including the validation number and a monetary amount owed to the holder, a portion of which may be the winnings of the user. The ticket printing or cashless instrument process then ends at end step 412.

When a holder of such a printed ticket redeems it, the validation number or code of the printed ticket is used to generate a new hash number using the same one-way hash function. If the new hash number matches a stored "confirmation" hash number, then the printed ticket can be paid out. Otherwise, it can be flagged as suspicious, and payment can be refused. Turning now to FIG. 7, after a start step 500, a "suspicious ticket counter" is similarly set to zero or some other start value at process step 502. A printed ticket or other cashless instrument is received at process step 504, whereupon its validation number is read at process step 506. This validation number is then used to generate a hash number at process step 508, with the algorithm used to generate the hash number being the same as that used in step 406 above. This newly generated hash number is compared to the hash numbers stored in the EZ Pay® server 110 or other system component at process step 510, and an inquiry is made at decision step 512 as to whether there is a complete match between the generated hash number and any hash number stored on the system.

If a match is found, then the ticket is accepted at step 524, whereupon the printed ticket holder is paid, and the process ends at end step 526. If the newly generated hash number does not match any hash numbers stored in the system, however, then the ticket is noted as suspicious (i.e., a likely counterfeit) at process step 514, and the suspicious ticket counter is incremented at process step 516. An inquiry is then made at decision step 518 as to whether the suspicious ticket counter has met or exceeded a specified threshold value. If not, then the ticket is simply rejected at process step 522. If the value has been met or exceeded though, then a likely pattern of suspicious tickets is noted or flagged at process step 520, and additional action can be taken. Of course, the ticket is then also rejected at step 522. Both here and in FIG. 5, a pattern of suspicious tickets can prompt additional security measures. For example, the date, time, location, camera recording and/or other data for each attempt to redeem a suspicious printed ticket can be recorded and used to assist in determining the identity of the likely thief. If the identification of suspicious printed tickets and/or patterns of printed tickets is performed sufficiently quickly, the likely thief can still be found at the gaming machine or facility where he or she was attempting to redeem the printed tickets.

The foregoing description, for purposes of explanation, used specific nomenclature to provide a thorough understanding of the invention. However, it will be apparent to one skilled in the art that the specific details are not required in order to practice the invention. In other instances, well-known circuits and devices are shown in block diagram form in order to avoid unnecessary distraction from the underlying invention. Thus, the foregoing descriptions of specific embodiments of the present invention are presented for purposes of illustration and description. They are not intended to be exhaustive or to limit the invention to the precise forms disclosed. Many modifications and variations are possible in view of the above teachings. For example, identification numbers can have predictable and unpredictable portions generated according to any method or approach. For instance, the predictable portion can be constant, sequential, or otherwise susceptible to prediction, while the unpredictable portion can be randomly generated, pseudo-randomly generated, or otherwise generated according to any method or approach that is not easily determined. As another example, validation numbers, codes and/or hash numbers or values can be determined by the gaming machine itself, with the numbers, codes or values then being forwarded to the appropriate server or storage location after the ticket has been printed.

The embodiments disclosed herein were chosen and described in order to best explain the principles of the invention and its practical applications, to thereby enable others skilled in the art to best utilize the invention and various embodiments with various modifications as are suited to the particular use contemplated. Other changes and modifications may be practiced, and it is understood that the invention is not to be limited by the foregoing details, but rather is to be defined by the scope of the appended claims and their equivalents.

What is claimed is:

1. A cashless instrument adapted for use in a wager-based gaming environment, the cashless instrument comprising:

a writable region adapted for the writing of a validation number or code to said cashless instrument; and a validation number or code written to said writable region upon the issuance of said cashless instrument to a user, said validation number or code having a predictable portion apparent from an observation of a plurality of similar cashless instruments and an unpredictable portion that is not apparent from the observation of said plurality of similar cashless instruments.

2. The cashless instrument of claim 1, wherein an indication of a possibly counterfeit cashless instrument can be made where said predictable portion is matched and where said unpredictable portion is not matched with any of a set of separately stored confirmation numbers or codes.

3. The cashless instrument of claim 1, wherein said predictable portion is a sequentially incremented number or code, and wherein said unpredictable portion is a randomly or pseudo-randomly generated number or code.

4. The cashless instrument of claim 1, wherein said cashless instrument is generated by a wager-based gaming machine.

5. The cashless instrument of claim 1, wherein said cashless instrument comprises a printed ticket.

6. The cashless instrument of claim 5, wherein said writable region comprises a printable surface, and wherein said validation number or code is printed to said printable surface.

7. A cashless instrument, comprising:

a writable region adapted for the writing of a validation number or code to said cashless instrument; and a validation number or code written to said writable region, said validation number or code having a predictable portion apparent from an observation of a plurality of similar cashless instruments and an unpredictable portion that is not apparent from the observation of said plurality of similar cashless instruments.

8. The cashless instrument of claim 7, wherein an indication of a possibly counterfeit cashless instrument can be made where a similar separate instrument has a comparable validation number or code having a first portion that matches said predictable portion and a second portion that does not match said unpredictable portion.

9. The cashless instrument of claim 7, wherein said predictable portion is a sequentially incremented number or code, and wherein said unpredictable portion is a randomly or pseudo-randomly generated number or code.

10. The cashless instrument of claim 7, wherein said cashless instrument comprises a printed ticket.

11. A method of detecting counterfeit cashless instruments, comprising:

receiving a cashless instrument having a validation number or code;

generating a hash number or value according to a one-way hash function from the validation number or code;

comparing the hash number or value to a plurality of confirmation numbers or values; and generating an indication of a counterfeit cashless instrument when the hash number or value does not match at least one of the plurality of confirmation numbers or values.

12. The method of claim 11, further comprising:

repeating said receiving, generating and comparing steps with further cashless instruments having further validation numbers or codes with further generated hash numbers or values; and generating a further indication of a counterfeit cashless instrument for each further validation number or code whose further generated hash number or value does not match at least one of the plurality of confirmation numbers or values.

13. The method of claim 12, further comprising:

generating an indication of a pattern of counterfeit cashless instruments.

14. The method of claim 11, wherein said cashless instrument comprises a printed ticket.

15. A method of detecting counterfeit cashless instruments, comprising:

receiving a cashless instrument having a validation number or code, the validation number or code having a predictable portion apparent from an observation of a plurality of similar valid cashless instruments, and an unpredictable portion that is not apparent from the observation of the plurality of similar valid cashless instruments;

comparing said validation number or code to one or more known confirmation numbers or codes;

matching said predictable portion of said validation number or code to a corresponding portion of one of said one or more known confirmation numbers or codes;

confirming that said unpredictable portion of said validation number or code does not match any of the corresponding portions of any of said one or more known confirmation numbers or codes; and generating an indication that said cashless instrument is counterfeit.

16. The method of claim 15, further comprising:

generating an indication of a pattern of counterfeit cashless instruments.

17. The method of claim 15, wherein said predictable portion is a sequentially incremented number or code, and wherein said unpredictable portion is a randomly or pseudo-randomly generated number or code.

18. The method of claim 15, wherein said cashless instrument is a printed ticket.

* * * * *

UNITED STATES PATENT AND TRADEMARK OFFICE

CERTIFICATE OF CORRECTION

PATENT NO. : 7,559,462 B2
APPLICATION NO. : 11/954537
DATED : July 14, 2009
INVENTOR(S) : Bronson et al.

It is certified that error appears in the above-identified patent and that said Letters Patent is hereby corrected as shown below:

COVER PAGE ITEM 63:

Add the following

--Related U.S. Application Data

(63) Continuation of application No. 10/938,934, filed on September 9, 2004, now Pat. No. 7,328,838--

Signed and Sealed this

Eighth Day of September, 2009

David J. Kappos

David J. Kappos
*Director of the United States Patent and Trademark Office*